US009896647B2

(12) United States Patent
Backer et al.

(10) Patent No.: US 9,896,647 B2
(45) Date of Patent: Feb. 20, 2018

(54) AUTOMATIC DISHWASHING DETERGENT WITH SYNERGISTIC SCALE INHIBITION

(71) Applicant: Rohm and Haas Company, Philadelphia, PA (US)

(72) Inventors: Scott Backer, Philadelphia, PA (US); Paul Mercando, Pennsburg, PA (US)

(73) Assignee: Rohm and Haas Company, Collegeville, PA (US)

( * ) Notice: Subject to any disclaimer, the term of this patent is extended or adjusted under 35 U.S.C. 154(b) by 29 days.

(21) Appl. No.: 14/910,123

(22) PCT Filed: Aug. 29, 2014

(86) PCT No.: PCT/US2014/053320
§ 371 (c)(1),
(2) Date: Feb. 4, 2016

(87) PCT Pub. No.: WO2015/034766
PCT Pub. Date: Mar. 12, 2015

(65) Prior Publication Data

US 2016/0208197 A1 Jul. 21, 2016

Related U.S. Application Data

(60) Provisional application No. 61/874,061, filed on Sep. 5, 2013.

(51) Int. Cl.
*C11D 3/37* (2006.01)

(52) U.S. Cl.
CPC ..... *C11D 3/378* (2013.01); *C11D 3/3769* (2013.01)

(58) Field of Classification Search
CPC ..... C11D 3/378; C11D 3/3757; C11D 3/3769
See application file for complete search history.

(56) References Cited

U.S. PATENT DOCUMENTS

| | | | | |
|---|---|---|---|---|
| 4,906,383 | A | 3/1990 | Chen et al. | |
| 4,913,880 | A | 4/1990 | Chen et al. | |
| 8,101,027 | B2 | 1/2012 | Vandermeulen et al. | |
| 2010/0167975 | A1 † | 7/2010 | Vandermeulen | |
| 2014/0303337 | A1 * | 10/2014 | Backer | C02F 5/12 526/312 |
| 2015/0291916 | A1 * | 10/2015 | Manna | C11D 3/3757 510/228 |

FOREIGN PATENT DOCUMENTS

| | | | |
|---|---|---|---|
| WO | 2006064940 | | 6/2006 |
| WO | 2006064940 | A1 † | 6/2006 |
| WO | 2007089001 | | 8/2007 |
| WO | 2007089001 | A1 † | 8/2007 |
| WO | 2009123322 | | 10/2009 |
| WO | 2009123322 | A1 † | 10/2009 |
| WO | 2014099237 | | 6/2014 |

OTHER PUBLICATIONS

Notification of material filed by a third party on Mar. 7, 2017 in corresponding Australian patent application No. 2014315495.

* cited by examiner
† cited by third party

*Primary Examiner* — Gregory E Webb
(74) *Attorney, Agent, or Firm* — Raef M. Shaltout; Thomas S. Deibert

(57) ABSTRACT

Described are automatic dishwashing detergents, comprising a builder, a surfactant, a polymer having sulfonic acid moieties, and a polymer having chelating moieties, wherein the polymer having chelating moieties comprises units derived from at least one carboxylic acid monomer, their salts or esters, an aminocarboxylate selected from iminodiacetic acid (IDA) and ethylenediamine triacetic acid (ED3A), and at least one glycidyl monomer selected from AGE, GA, GMA.

11 Claims, No Drawings

AUTOMATIC DISHWASHING DETERGENT WITH SYNERGISTIC SCALE INHIBITION

CROSS REFERENCE TO RELATED APPLICATIONS

This application is a 35 USC § 371 national phase filing of PCT/US2014/053320 filed Aug. 29, 2014, which claims benefit of priority from U.S. Provisional Patent Application No. 61/874,061, filed Sep. 5, 2013 which application is incorporated by reference herein in its entirety.

FIELD

The present invention relates to automatic dishwashing detergent containing synergistic combinations of acrylic polymers, some of which contain sulfonic acid moieties and some of which contain chelating moieties, for inhibiting scale formation. In particular, the polymers containing chelating moieties are the product of at least one carboxylic acid monomer, an aminocarboxylate selected from iminodiacetic acid (IDA), ethylenediamine triacetic acid (ED3A), or their salts, or mixtures thereof, and a glycidyl monomer selected from an allyl glycidyl ether (AGE), glycidyl (meth) acrylate (GA or GMA).

BACKGROUND

Phosphates were previously routinely included in detergents, including automatic dishwashing (ADW) detergents, due to their excellent chelating agent performance. Since use of phosphates in detergents is now limited or banned in most jurisdictions due to environmental concerns, a significant amount of research and development has been performed to identify and develop new and effective chelating agents, dispersants, and/or builders for ADW detergents having little or no phosphate in them. Polyacrylate dispersants are known to inhibit crystal growth and assist with particle dispersion. Amino carboxylates stoichiometrically bind metal ions, thereby enhancing scale inhibition, and are being explored as another class of chelants that may replace phosphates in detergents and other aqueous systems. Polyacrylate polymers which also contain amino carboxylate moieties have been found to be as effective as previously used builders and chelants such as phosphates, aminocarboxylates and polyacrylates containing sulfonate moieties. See, e.g., U.S. Patent Application Publication No. WO/2014/099237 (DOW74191/U.S. Ser. No. 61/739,262, filed Dec. 19, 2012; DOW75261/EP Patent Appln No. 13290210.7 filed Sep. 5, 2013), which describe polymers comprising polymerized units derived from carboxylic acid monomers, amino caboxylate monomers and glycidyl monomers that are useful as builders and chelants in automatic dishwashing detergents.

A family of patents which includes U.S. Pat. Nos. 4,906,383 and 4,913,880 described polymers useful for water treatment and derived from α-, β-ethylenically unsaturated monomers, which contain carboxylic acid or carboxylic amide functionalities, and amine-containing allyl ether monomers. These patents taught that the amine-containing allyl ether monomers were derived from the ring opening reaction of a (meth)allylic glycidyl ether, preferably allyl glycidyl ether (AGE), with ammonia, primary, secondary or tertiary amines, for example carboxylate-containing amines such as iminodiacetic acid (IDA). It was contemplated that these polymers, comprising both amine and carboxylic functionalities, would be useful in a broad range of water treatment applications including scale inhibition in water systems such as cooling, boiler, gas scrubbing, and pulp and paper manufacturing systems, as well as corrosion inhibitors and chelating activity for various metal ions in solution. It was further stated that such polymers may be used to prevent precipitation of various calcium-based fouling solids, as well as various metal oxide and metal hydroxide deposits, in water systems.

Moreover, polyacrylate polymers which contain sulfonic acid monomers, such as 2-acrylamido-2-methylpropane sulfonic acid (AMPS), are known to provide good inhibition against silica-based scale formation. Polymers commercially available under the tradename ACUSOL 588 from Dow Chemical Company contain acrylic acid and AMPS monomers and have been marketed for use in ADW detergents to control silica- and phosphorus-based scales. With the advent of phosphorus-free ADW detergents, ACUSOL 588 and similar dispersants remain effective at controlling silica-based scale.

Notwithstanding the foregoing developments, there remains a need for anti-scaling agents for ADW detergents to replace the now-disfavored phosphates that previously inhibited scale build-up.

SUMMARY OF THE INVENTION

The present invention provides an automatic dishwashing detergent, comprising: (A) a builder; (B) a surfactant; (C) a polymer having sulfonic acid moieties, and (D) a polymer having chelating moieties, wherein the polymer (C) is different from the polymer (D). The polymer having sulfonic acid moieties (C) comprises polymerized units derived from at least one carboxylic acid monomer and at least one sulfonic acid monomer. The polymer having chelating moieies (D) comprising polymerized units derived from: (i) at least one carboxylic acid monomer; (ii) a glycidyl monomer selected from allyl glycidyl ether (AGE) or glycidyl (meth) acrylate (GA or GMA); and (iii) an aminocarboxylate selected from iminodiacetic acid (IDA), ethylenediamine triacetic acid (ED3A), their salts, or mixtures thereof.

In some embodiments of the detergent according to the present invention, the polymer (D) is selected from one of the following classes of polymers: (1) a polymer comprising polymerized units derived from (i) at least one carboxylic acid monomer or its salt; (ii) at least one glycidyl monomer selected from allyl glycidyl ether (AGE) and glycidyl (meth) acrylate (GA or GMA); and (iii) iminodiacetic acid (IDA) or its salts, said polymer having Formula I:

Formula I

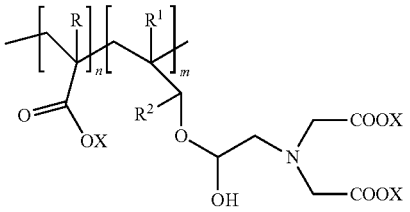

wherein m is an integer from 1 to 6; n is an integer from 1 to 20; each of R and $R^1$ is, independently, H or $CH_3$; $R^2$ is $H_2$ or =O; and each X is, independently, H, $K^+$, $Na^+$, or ammonium ($NH_4^+$); or (2) a polymer comprising polymerized units derived from (i) at least one carboxylic acid monomer or its salt; (ii) at least one glycidyl monomer selected from allyl glycidyl ether (AGE) and (meth)acrylate (GA or GMA); and (iii) ethylenediamine triacetic acid (ED3A) or its salts, said polymer having Formula II:

Formula II

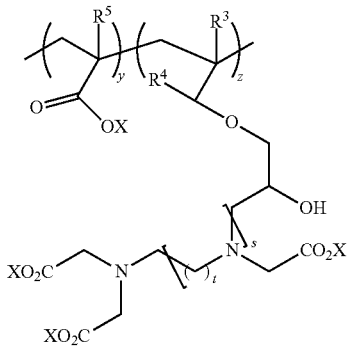

wherein s is 1, 2, or 3; t is 1, 2, or 3; z is an integer from 1 to 6; y is an integer from 1 to 20, each of $R^3$ and $R^5$ is, independently, H or $C_1$-$C_4$ alkyl; $R^4$ is $H_2$ or =O, X is, independently, H, $K^+$, $Na^+$, or ammonium ($NH_4^+$).

In some embodiments of the detergent according to the present invention, the polymer (D) has Formula I and comprises polymerized units derived from at least one carboxylic acid monomer and at least one ethylenically unsaturated aminocarboxylate monomer, where the ethylenically unsaturated aminocarboxylate monomer is the reaction product of said at least one glycidyl monomer and IDA.

In some embodiments of the detergent according to the present invention, the polymer (D) has Formula II and comprises polymerized units derived from at least one carboxylic acid monomer and at least one ethylenically unsaturated aminocarboxylate monomer, wherein said ethylenically unsaturated aminocarboxylate monomer is the reaction product of said at least one glycidyl monomer and ED3A.

In some embodiments of the detergent according to the present invention, the at least one carboxylic acid monomer or its salt of the polymer (C) is selected from: acrylic acid, methacrylic acid, their salts, and mixtures thereof.

In some embodiments of the detergent according to the present invention, the at least one sulfonic acid monomer or its salt of the polymer (C) is 2-acrylamido-2-methylpropane sulfonic acid (AMPS).

In some embodiments of the detergent according to the present invention, the at least one carboxylic acid monomer or its salt of the polymer (D) is selected from: acrylic acid, methacrylic acid, their salts, and mixtures thereof.

In some embodiments of the detergent according to the present invention, the polymer (D) has Formula I and comprises polymerized units derived from (i) at least one carboxylic acid monomer or its salt, (ii) allyl glycidyl ether (AGE); and (iii) iminodiacetic acid (IDA) or its salts.

In some embodiments of the detergent according to the present invention, the polymer (D) has Formula II and comprises polymerized units derived from (i) at least one carboxylic acid monomer or its salt, (ii) allyl glycidyl ether (AGE); and (iii) ethylenediamine triacetic acid (ED3A) or its salts.

In some embodiments of the detergent according to the present invention, the polymer (D) has Formula II and comprises polymerized units derived from (i) at least one carboxylic acid monomer or its salt, (ii) glycidyl methacrylate (GMA), and (iii) ethylenediamine triacetic acid (ED3A) or its salts.

DETAILED DESCRIPTION

All percentages stated herein are weight percentages (wt %), unless otherwise indicated.

Temperatures are in degrees Celsius (° C.), and ambient temperature means between 20° C. and 25° C., unless specified otherwise.

Weight percentages of monomers in a polymer are based on the total weight of monomers present in the polymerization mixture from which the polymer is produced.

Weight average molecular weights, $MW_w$, are measured by gel permeation chromatography (GPC) using polyacrylic acid standards, as is known in the art.

The term "polymerized units derived from" as used herein refers to polymer molecules that are synthesized according to polymerization techniques wherein a product polymer contains "polymerized units derived from" the constituent monomers which are the starting materials for the polymerization reactions.

"Polymer" means a polymeric compound or "resin" prepared by polymerizing monomers, whether of the same or different types. The generic term "polymer," as used herein, includes the terms "homopolymer" and "copolymer". For example, homopolymers are polymeric compounds are understood to have been prepared from a single type of monomer. Copolymers, as this term is used herein, means polymeric compounds prepared from at least two different types of monomers. For example, an acrylic acid polymer comprising polymerized units derived only from acrylic acid monomer is a homopolymer, while a polymer comprising polymerized units derived from acrylic acid, methacrylic acid, and butyl acrylate is a copolymer.

Hereinbelow, where "ethylenically unsaturated" is used to describe a molecule or moiety, it means that that molecule or moiety has one or more carbon-carbon double bonds, which renders it polymerizable. The term "ethylenically unsaturated" includes monoethylenically unsaturated (having one carbon-carbon double bond) and multi-ethylenically unsaturated (having two or more carbon-carbon double bonds).

As used herein, "carboxylic acid monomers or their esters" include, for example, acrylic acid, methacrylic acid, their salts, their esters, and mixtures thereof.

As used herein "(meth)acrylic acid" means acrylic acid, methacrylic acid, or mixtures thereof.

As used herein, "(meth)acrylate" means esters of acrylic acid, esters of methacrylic acid, or mixtures thereof.

Polymers having sulfonic acid moieties are known to provide excellent silica scale inhibition in ADW detergents. Polymers having chelating moieties derived from aminocarboxylate monomers have recently been discovered to provide excellent chelating activity when included in ADW detergents. Surprisingly, applicants have further discovered that combinations of such polymers behave synergistically and provide enhanced inhibition of scale formation.

The present invention relates to automatic dishwashing detergent containing synergistic combinations of acrylic polymers, some of which contain sulfonic acid moieties and some of which contain chelating moieties, for inhibiting scale formation.

More specifically, the automatic dishwashing detergent of the present invention comprises: (A) a builder; (B) a surfactant; (C) a polymer having sulfonic acid moieties; and (D) a polymer having chelating moieties, wherein the polymer (C) is different from the polymer (D).

Applicant have found that when polymers having sulfonic acid moieties (C) are also included in ADW detergents, along with the polymers having chelating moieties (D), a synergistic effect occurs where the scale inhibition is improved compared to the scale inhibition provided by either polymer (C) or (D) alone, and is improved compared to the expected cumulative scale inhibition provided by polymers (C) and (D).

In some embodiments, the builder (A) is at least one of sodium citrate, citric acid, or sodium carbonate.

In some embodiments, the surfactant (B) is at least one nonionic surfactant that is typically used in automatic dishwashing detergents, for example, low foam surfactants (ethylene oxide/propylene oxide/ethylene oxide triblock polymers, alkyl-ethylene oxide/propylene oxide/butyl oxide polymers). Such surfactants are well known, and selection thereof is understood, by persons of ordinary skill in the relevant art. Additional suitable surfactants (B) are commercially available from The Dow Chemical Company of Midland Mich., USA, and are listed in the following table.

| Name | Summary Composition |
|---|---|
| DOWFAX 20B102 | linear alcohol EO BO |
| TRITON DF-16 | linear alcohol EO PO |
| TERGITOL L-61 E | EO/PO copolymer |
| ECOSURF LF-20 | secondary alcohol EO BO |

(Abbreviations above as follows: EO = ethylene oxide, BO = butylene oxide, PO = propylene oxide)
DOWFAX, TRITON, TERGITOL and ECOSURF are trademarks of Dow Chemical Company of Midland, Michigan, USA.

The polymer having sulfonic acid moieties (C) in the ADW detergent according to the present invention comprises polymerized units derived from at least one carboxylic acid monomer and at least one sulfonic acid monomer. More particularly, carboxylic acid monomers suitable for the polymer (C) are selected from the group consisting of: (meth)acrylic acid, their salts and mixtures thereof. Suitable sulfonic acid monomers for the polymer (C) include, for example, 2-acrylamido-2-methylpropane sulfonic acid (AMPS), 2-(meth)acrylamido-2-methylpropane sulfonic acid, 4-styrenesulfonic acid, vinylsulfonic acid, 2-sulfoethyl (meth)acrylic acid, 2-sulfopropyl(meth)acrylic acid, 3-sulfopropyl(meth)acrylic acid, and 4-sulfobutyl(meth)acrylic acid, and salts thereof.

Furthermore, the polymer (C) may contain from 51 wt % to 98 wt % of the at least one carboxylic acid monomer, for example from 55 wt % to 90 wt %, or even from 55 wt % to 80 wt %. Consequently, the polymer (C) may contain from 2 wt % to 49 wt % of the at least one sulfonic acid monomer, for example from 10 wt % to 45 wt %, or even from 20 wt % to 45 wt %.

The polymer (C) may be present in the ADW detergent according to the present invention in an amount of from 0.5 wt % to 11.5 wt %, based on the total weight of the ADW detergent on a dry basis. For example, without limitation, the ADW detergent may comprise the polymer (C) in an amount of from 0.5 wt % to 10 wt %, or from 0.5% to 6 wt %, or even from 0.5 wt % to 5 wt %.

The polymer having chelating moieties (D) in the ADW detergent according to the present invention comprises polymerized units derived from (i) at least one carboxylic acid monomer; (ii) a glycidyl monomer selected from allyl glycidyl ether (AGE) or glycidyl (meth)acrylate (GA or GMA); and (iii) an aminocarboxylate selected from iminodiacetic acid (IDA), ethylenediamine triacetic acid (ED3A), their salts, or mixtures thereof.

The polymer (D) may be present in the ADW detergent according to the present invention in an amount of from 0.5 wt % to 11.5 wt %, based on the total weight of the ADW detergent on a dry basis. For example, without limitation, the ADW detergent may comprise the polymer (D) in an amount of from 0.5 wt % to 10 wt %, or from 0.5% to 6 wt %, or even from 0.5 wt % to 5 wt %.

Generally, the carboxylic acid monomers (i) suitable for the polymer (D) are the same as for the polymer (C) and are selected from acrylic acid, methacrylic acid, their salts, and mixtures thereof. The polymer (D) may comprise from 50 wt % to 98 wt % of carboxylic acid monomers or their salts, based on the total weight of the polymer (D). In some embodiments, the polymer (D) comprises at least 51 wt %, for example, at least 60 wt %, or at least 70 wt %, or even at least 80 wt %, of polymerized units derived from at least one carboxylic acid monomer or its salt. In some embodiments, the polymer (D) comprises up to 95 wt %, or up to 90 wt %, or up to 80 wt %, or even up to 75 wt %, of polymerized units derived from at least one carboxylic acid monomer or its salt.

In some embodiments, the polymer having chelating moieties (D) is selected from one of the following classes of polymers:

(1) a polymer comprising polymerized units derived from (i) at least one carboxylic acid monomer or its salt; (ii) at least one glycidyl monomer selected from allyl glycidyl ether (AGE) and glycidyl (meth)acrylate (GA or GMA); and (iii) iminodiacetic acid (IDA) or its salts, said polymer having Formula I:

Formula I

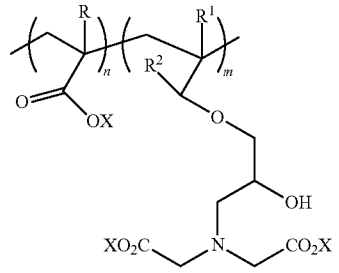

wherein m is an integer from 1 to 6; n is an integer from 1 to 20; each of R and $R^1$ is, independently, H or $CH_3$; $R^2$ is $H_2$ or =O; and each X is, independently, H, $K^+$, $Na^+$, or ammonium ($NH_4^+$); or (2) a polymer comprising polymerized units derived from (i) at least one carboxylic acid monomer or its salt; (ii) at least one glycidyl monomer selected from allyl glycidyl ether (AGE) and (meth)acrylate (GA or GMA); and (iii) ethylenediamine triacetic acid (ED3A) or its salts, said polymer having Formula II:

Formula II

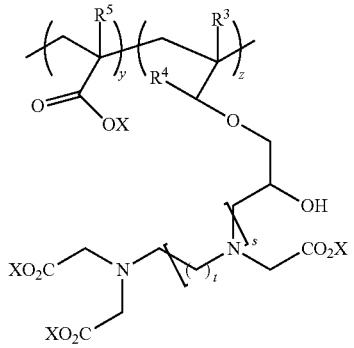

wherein s is 1, 2, or 3; t is 1, 2, or 3; z is an integer from 1 to 6; y is an integer from 1 to 20, each of $R^3$ and $R^5$ is, independently, H or $C_1$-$C_4$ alkyl; $R^4$ is $H_2$ or =O, X is, independently, H, $K^+$, $Na^+$, or ammonium ($NH_4^+$).

In some embodiments, the polymer (D) is the product of (meth)acrylic acid, AGE and IDA, and has Formula I wherein R is H or $CH_3$, $R^1$ is H, and $R^2$ is $H_2$.

In some embodiments, the polymer (D) is the product of (meth)acrylic acid, GMA and IDA, and has Formula I wherein R is H or $CH_3$, $R^1$ is $CH_3$, and $R^2$ is =O.

In some embodiments, where the polymer (D) has Formula I, m may be an integer from 1 to 4, or from 1 to 3, or even from 1 to 2. In some such embodiments, m is 1.

In some embodiments, where the polymer (D) has Formula I, n may be an integer from 1 to 16, or from 4 to 16, or from 5 to 16, or even from 5 to 12. In some embodiments, n is 1.

In some embodiments, the polymer (D) is the product of (meth)acrylic acid, AGE and ED3A, and has Formula II wherein each of $R^3$ and $R^5$ is H, and $R^4$ is $H_2$, s is 1 and t is 1.

In some embodiments, the polymer (D) is the product of (meth)acrylic acid, GMA and ED3A, and has Formula II wherein $R^3$ is H, $R^4$ is =O, $R^5$ is H or $CH_3$, $R^5$ is H or $CH_3$, s is 1 and t is 1.

In some embodiments, where the polymer (D) has Formula II, z may be an integer from 1 to 4, or from 1 to 3, or even from 1 to 2. In some such embodiments, z is 1.

In some embodiments, where the polymer (D) has Formula II, y may be an integer from 1 to 16, or from 4 to 16, or from 5 to 16, or even from 5 to 12. In some such embodiments, y is 1.

The polymer having chelating moieties (D) may be prepared by first reacting the aminocarboxylate (IDA or ED3A), or its salt, with a glycidyl monomer (AGE, GA or GMA) to form ethylenically unsaturated aminocarboxylic monomers, including IDA-AGE, IDA-GA and IDA-GMA, or ED3A-AGE, ED3A-GA and ED3A-GMA, respectively. In practice, in either case, a mixture of isomers is produced.

Where ethylenically unsaturated aminocarboxylate monomers are produced from the reaction of a glycidyl monomer (AGE, GA or GMA) and iminodiacetic acid (IDA), said aminocarboxylate monomer has Formula III:

Formula III

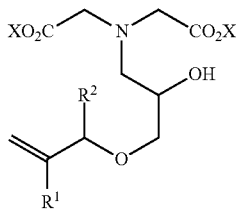

wherein $R^1$ is H or $CH_3$; $R^2$ is $H_2$ or =O; and each X is, independently, H, $K^+$, $Na^+$, or ammonium ($NH_4^+$).

Where ethylenically unsaturated aminocarboxylate monomers are produced from the reaction of a glycidyl monomer (AGE, GA or GMA) and ethylenediamine triacetic acid (ED3A), said aminocarboxylate monomer has Formula IV:

Formula IV

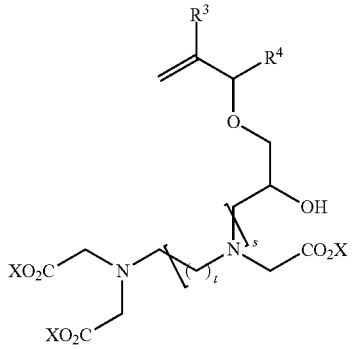

wherein s is 1, 2 or 3; t is 1, 2 or 3; $R^3$ is H or $CH_3$; $R^4$ is $H_2$ or =O; and each X is, independently, H, $K^+$, $Na^+$, or ammonium ($NH_4^+$).

In some embodiments, s is 1.

In some embodiments, t is 1.

The ethylenically unsaturated aminocarboxylic monomers, whether synthesized as above or obtained in already-synthesized form, are then polymerized with the carboxylic acid or its salt (i) to produce the polymers of Formula I or Formula II.

More particularly, polymerization of ethylenically unsaturated aminocarboxylate monomers having Formula III with (meth)acrylic acid or its salts produces the polymer (D) having Formula I described above.

Polymerization of ethylenically unsaturated aminocarboxylate monomers having Formula IV with (meth)acrylic acid or its salts produces the polymer (D) having Formula II described above.

Of course, as will be recognized by persons of ordinary skill in the relevant art, aminocarboxylates of both Formula III and Formula IV may be polymerized with the carboxylic acid or its salt to form a polymer having chelating moieties (D) having a structure similar to, but not the same as, Formulas I and II.

Alternatively, the polymer having chelating moieties (D) may be prepared by first polymerizing the glycidyl monomer (selected from AGE, GA, GMA, and their salts) with the carboxylic acid (selected from acrylic acid, methacrylic acid, their salts, and combinations thereof) to provide a polymer backbone. Next, the aminocarboxylate of choice, IDA or ED3A, is grafted onto the polymer backbone to produce the polymer of Formula I or Formula II, respectively. Of course, as will be recognized by persons of ordinary skill in the relevant art, both IDA and ED3A may be grafted on to such polymer backbones to form a polymer having chelating moieties (D) having a structure similar to, but not the same as, Formulas I and II.

The method of polymerization is not particularly limited and may be any method known, now or in the future, to persons of ordinary skill including, but not limited to, emulsion, solution, addition and free-radical polymerization techniques. When initiator is used, it may be added in any fashion, at any time during the process. Production of the polymer may also involve the use of a chain regulator.

In some embodiments, either or both of the polymer having sulfonic acid moieties (C) or the polymer having chelating moieties (D) may further comprise an additional monomer component comprising one or more ethylenically unsaturated monomers. Ethylenically unsaturated monomers suitable for use as the additional monomer component may, for example, be selected from the group consisting of: carboxylic acids except for (meth)acrylic acid, esters of carboxylic acids, carboxylic acid anhydrides, imides, amides, styrenes, sulfonic acids, $C_1$-$C_{12}$ aliphatic alcohols, and combinations thereof. Each of the polymer (C) and the polymer (D) may comprise one or more of such additional monomer components in an amount of from 1 to 30 wt %, based on the total weight of the polymer of which they are components.

For example, carboxylic acid monomers suitable for use as the additional monomer component of the polymer (C), the polymer (D), or both, include formic acid, acetic acid, butyric acid, propionic acid, and salts and mixtures thereof. Suitable sulfonic acid monomers include, for example, 2-acrylamido-2-methylpropane sulfonic acid (AMPS), 2-(meth)acrylamido-2-methylpropane sulfonic acid, 4-styrenesulfonic acid, vinylsulfonic acid, 2-sulfoethyl(meth)

acrylic acid, 2-sulfopropyl(meth)acrylic acid, 3-sulfopropyl (meth)acrylic acid, and 4-sulfobutyl(meth)acrylic acid, and salts thereof.

Further examples of ethylenically unsaturated monomers suitable for use as the additional monomer component of the polymer (C), the polymer (D), or both, include, without limitation, itaconic acid, maleic acid, maleic anhydride, crotonic acid, vinyl acetic acid, acryloxypropionic acid, methyl acrylate, ethyl acrylate, butyl acrylate, methyl methacrylate, ethyl methacrylate, butyl methacrylate and isobutyl methacrylate; hydroxyalkyl esters of acrylic or methacrylic acids such as hydroxyethyl acrylate, hydroxypropyl acrylate, hydroxyethyl methacrylate, and hydroxypropyl methacrylate; acrylamide, methacrylamide, N-tertiary butyl acrylamide, N-methyl acrylamide, N,N-dimethyl acrylamide; acrylonitrile, methacryionitrile, allyl alcohol, allyl sulfonic acid, allyl phosphonic acid, vinylphosphonic acid, dimethylaminoethyl acrylate, dimethylaminoethyl methacrylate, phosphoethyl methacrylate, phosphonoethyl methacrylate (PEM), and sulfonoethyl methacrylate (SEM), N-vinyl pyrollidone, N-vinylformamide, N-vinylimidazole, ethylene glycol diacrylate, trimethylotpropane triacrylate, diallyl phthalate, vinyl acetate, styrene, divinyl benzene, allyl acrylate, 2-acrylamido-2-methyl propane sulfonic acid (AMPS) and its salts or combinations thereof.

The ADW detergents according to the present invention are suitable for use in automatic dish, or industrial ware, washing machines. In practice, such ADW detergents may be formulated in any conventional form, such as tablets, powders, monodose units, multi-component monodose units, sachets, pastes, liquids, or gels. In practice, with selection of an appropriate product form and addition time, either the polymer having sulfonic acid moieties (C) or the polymer having chelating moieties (D), or both polymers (C) and (D), may be present in the prewash, main wash, penultimate rinse, final rinse, or any combination of these cycles, as is determinable by persons of ordinary skill in the relevant art.

In addition to the above-described polymer, builder and surfactant, the automatic dishwashing detergent of the present invention may further comprise at least one bleaching agent, aminocarboxylate, or enzyme. A preferred bleaching agent is sodium percarbonate. Exemplary aminocarboxylates include methylglycine diacetic acid (MGDA), glutamic acid diacetic acid (GLDA), and their sodium salts, and 2-hydroxyethyliminodiacetic acid disodium salt (HEIDA). The enzyme may, for example, be at least one of lipases, proteases, or amylases.

In some embodiments, the detergent further comprises a phosphonate, preferably hydroxyethyldiphosphonic acid (HEDP).

In some embodiments, the detergent is a phosphate-free detergent.

In some embodiments, the detergent further comprises fragrances; solvents ((i.e. polyglycols, alcohols, diols, triols, glycol ethers, water); coupling agents (sodium xylenesulfonate (SXS), sodium cumene sulfonate (SCS)); filler/adjuvants (sodium sulfate, sodium chloride); binders (polyethylene glycol (PEG)); disintegrants (superabsorbent polymer, cellulosic); or corrosion inhibitors (silicates).

EXAMPLES

Example 1—Synthesis and Base Formulas

Synthesis of ED3A-AGE Monomer (An Ethylenically Unsaturated Aminocarboxylate Monomer)

To a 1 L round bottom flask equipped with a magnetic stirbar and an addition funnel, 172 g of N,N,N'-ethylenediaminetriacetic acid, sodium salt (ED3A) solution (29% active) is charged. The solution is placed in a water bath, and set to stir at a minimum of 300 rpm. 0.4 g of benzyltrimethylammonium chloride (BTAC)) is charged to the vessel and allowed to dissolve completely over approximately five minutes. During this time, 18.85 g of allyl glycidyl ether (AGE) is charged to the addition funnel. The AGE is added dropwise to the stirring reaction mass, and when complete, allowed to stir at room temperature until the reaction mass transitioned from two phases to a single phase. This is determined by visual observation, in which prior to completion, the reaction mass is hazy, and separates into two distinct phases upon termination of stirring. Upon completion, the reaction mass is observed to be a transparent yellow solution, which is stable upon termination of stirring. At this stage the product is a yellow solution of pH 11.5 and active level of 37.5 wt. % ED3A-AGE. This solution is stable to storage under ambient conditions and can be used as such.

Synthesis of IDA-AGE Monomer (An Ethylenically Unsaturated Aminocarboxylate Monomer)

To a 1 L round bottom flask equipped with a magnetic stirbar and an addition funnel, 211.7 g of iminodiacetic acid (IDA) solution (20.0) % active was charged. The solution was placed in a water bath, and set to stir at a minimum of 300 rpm, and heated to 35° C. During this time, 27.3 grams of allyl glycidyl ether (AGE) was charged to an addition funnel. The AGE was added drop wise to the stirring reaction mass over 20-30 minutes. When complete, the mixture was allowed to stir at 35° C. until the reaction mass transitioned from two phases to a single phase, requiring a hold time of 30-60 minutes. This was determined by visual observation, in which prior to completion, the reaction mass was hazy, and would separate into two distinct phases upon termination of stirring. Upon completion, the reaction mass was observed to be a transparent yellow solution, which was stable upon termination of stirring. At this stage the product is a yellow solution of pH 12 and active level of 29.84 wt % IDA-AGE. This solution is stable to storage under ambient conditions and can be used as such.

Polymer I

Synthesis of Poly-(AA/ED3A-AGE)

To a three liter round bottom flask, equipped with a mechanical stirrer, heating mantle, thermocouple, condenser and inlets for the addition of monomer, initiator and chain transfer agent (CTA) was charged 57.01 grams of 37.5% ED3A-AGE monomer and 60.6 grams of deionized water. The mixture was set to stir and heated to 78° C. (+/−2° C.). In the meantime, a monomer solution of 203.64 grams of glacial acrylic acid and was added to a graduated cylinder for addition to the flask. An initiator solution of 6.0 grams of sodium persulfate was dissolved in 50 grams of deionized water and added to a syringe for addition to the kettle. A chain transfer agent (CTA) solution of 58.5 grams of sodium metabisulfite dissolved in 150 grams of deionized water was added to a syringe for addition to the kettle.

Once the kettle contents reached reaction temperature of 78° C., the monomer, initiator and CTA solutions were begun. The monomer feed was added over 90 minutes, CTA cofeed added over 80 minutes and initiator cofeed added over 95 minutes at 78° C.

At the completion of the feeds, 15 grams of deionized water was added to the monomer feed vessel, as rinse. The reaction was held for 15 minutes at 78° C. In the meantime, two chaser solutions of 0.87 grams of sodium persulfate and 25 grams of deionized water was mixed and set aside.

At the completion of the hold, the above solutions were added linearly over 10 minutes and held for 20 minutes at 78° C. The chaser solution preparations were repeated and added to the kettle over 10 minutes, followed by a 20 minute hold.

At the completion of the final hold, cooling was begun with the addition of 30 grams of deionized water. At 50° C. or below a solution of 207.68 grams of 50% sodium hydroxide was added to an addition funnel and slowly added to the kettle, controlling the exotherm to keep the temperature below 65° C. Finally, 7.3 grams of a scavenger solution of 35% hydrogen peroxide was added to the kettle.

The reaction product was then cooled and packaged.

The final Polymer I had a solids content of 40.65% (as measured in a forced draft oven at 150° C. for 60 minutes). The pH of the solution was 7.0 and final molecular weight as measured by Gel Permeation Chromatography was 6,741 Daltons.

Polymer II

Synthesis of Poly-(AA/IDA-AGE)

To a three liter round bottom flask, equipped with a mechanical stirrer, heating mantle, thermocouple, condenser and inlets for the addition of monomer, initiator and chain transfer agent (CTA) was charged 59.65 grams of 37.72% IDA-AGE (as prepared above) and 15 grams of deionized water. The mixture was set to stir and heated to 78° C. (+/−2° C.). In the meantime, a monomer solution of 202.5 grams of glacial acrylic acid and was added to a graduated cylinder for addition to the flask. An initiator solution of 6.0 grams of sodium persulfate was dissolved in 50 grams of deionized water and added to a syringe for addition to the kettle. A chain transfer agent (CTA) solution of 40.5 grams of sodium metabisulfite dissolved in 150 grams of deionized water was added to a syringe for addition to the kettle.

Once the kettle contents reached reaction temperature of 78° C., the monomer, initiator and CTA solutions were begun. The monomer feed was added over 90 minutes, CTA cofeed added over 80 minutes and initiator cofeed added over 95 minutes at 78° C.

At the completion of the feeds, 15 grams of deionized water was added to the monomer feed vessel, as rinse. The reaction was held for 15 minutes at 78° C. In the meantime, two chaser solutions of 0.87 grams of sodium persulfate and 25 grams of deionized water was mixed and set aside.

At the completion of the hold, the above solutions were added linearly over 10 minutes and held for 20 minutes at 78° C. The chaser solution preparations were repeated and added to the kettle over 10 minutes, followed by a 20 minute hold.

At the completion of the final hold, cooling was begun with the addition of 30 grams of deionized water. At 50° C. or below a solution of 210.3 grams of 50% sodium hydroxide was added to an addition funnel and slowly added to the kettle, controlling the exotherm to keep the temperature below 65° C. Finally, 7.0 grams of a scavenger solution of 35% hydrogen peroxide was added to the kettle.

The reaction product was then cooled and packaged.

The final Polymer II had a solids content of 39.42% (as measured in a forced draft oven at 150° C. for 60 minutes). The pH of the solution was 7.45 and final molecular weight as measured by Gel Permeation Chromatography was 5,663 Daltons.

Polymer III

Synthesis of Poly-(AA/IDA-AGE)

The procedure used to prepare Polymer II above was followed, except that 89.5 grams of 29.84% IDA-AGE (as prepared above) and a monomer solution of 191.25 grams of glacial acrylic acid were used.

The final Polymer III had a solids content of 39.63% (as measured in a forced draft oven at 150° C. for 60 minutes). The pH of the solution was 7.05 and final molecular weight as measured by Gel Permeation Chromatography was 5,905 Daltons.

Polymer IV

Synthesis of Poly-(AA/IDA-AGE)

The procedure used to prepare Polymer II above was followed, except that 124.24 grams of 36.22% IDA-AGE and a monomer solution of 180 grams of glacial acrylic acid were used.

The final Polymer IV had a solids content of 39.61% (as measured in a forced draft oven at 150° C. for 60 minutes). The pH of the solution was 7.34 and final molecular weight as measured by Gel Permeation Chromatography was 6,392 Daltons.

Polymer V

Synthesis of Poly-(AA/ED3A-AGE)

The procedure used to prepare Polymer I above was followed, except that 57 grams of 37.5% ED3A-AGE and a monomer solution of 203.63 grams of glacial acrylic acid were used.

The final Polymer IV had a solids content of 37.41% (as measured in a forced draft oven at 150° C. for 60 minutes). The pH of the solution was 7.55 and final molecular weight as measured by Gel Permeation Chromatography was 9,022 Daltons.

Polymer VI

Synthesis of Poly-(AA/ED3A-AGE)

The procedure used to prepare Polymer I above was followed, except that 81 grams of 37.5% ED3A-AGE (as prepared above) and a monomer solution of 222.75 grams of glacial acrylic acid were used.

The final Polymer VI had a solids content of 35.79% (as measured in a forced draft oven at 150° C. for 60 minutes). The pH of the solution was 7.16 and final molecular weight as measured by Gel Permeation Chromatography was 6,685 Daltons.

TABLE 1

Compositions and Properties of Sample Polymers I-IV

| Sample # | Monomer Composition | CTA* (wt %) | Solids (%) | pH | Viscosity (cps) | $MW_w$ (Daltons) |
|---|---|---|---|---|---|---|
| Polymer I | 90.5% AA/9.5% ED3A-AGE | 26 SMBS** | 40.65 | 7 | 99 | 6,741 |
| Polymer II | 90 AA/10 IDA-AGE | 18 SMBS | 39.42 | 7.5 | 89 | 5.663 |
| Polymer III | 85 AA/15 IDA-AGE | 18 SMBS | 39.63 | 7.2 | 107 | 5,905 |

TABLE 1-continued

Compositions and Properties of Sample Polymers I-IV

| Sample # | Monomer Composition | CTA* (wt %) | Solids (%) | pH | Viscosity (cps) | $MW_w$ (Daltons) |
|---|---|---|---|---|---|---|
| Polymer IV | 80 AA/20 IDA-AGE | 21.6 SMBS | 39.61 | 7.34 | 59 | 6,390 |
| Polymer V | 90.5 AA/9.5 ED3A-AGE | 7.4 NaHP | 37.41 | 7.55 | 114 | 9,022 |
| Polymer VI | 66 AA/25 AMPS/9 ED3A-AGE | 21.1 SMBS | 35.79 | 7.16 | 38 | 6,685 |

*Chain Transfer Agent levels are in wt % and based on the total weight of monomers (i), (ii) & (iii)
**SMBS = Sodium metabisulfite
***NaHP = Sodium hypophosphite Base Formulas A and B were prepared and then used to formulate exemplary ADW detergent formulations containing varying types and combinations of dispersants (i.e., polymers having sulfonic acid moieties and polymers having chelating moieties) which were tested, as described in further detail below. The compositions of Base Formulas A and B are listed in Table 2.

TABLE 2

Base Formulas A & B Compositions

| Ingredients | Formula A (wt %) | Formula B (wt %) | Supplier | Function |
|---|---|---|---|---|
| Sodium carbonate | 30 | 25 | Aldrich | Builder |
| Percarbonate | 15 | 15 | Aldrich | Bleaching agent |
| Sodium citrate | 5 | 10 | Aldrich | Builder |
| BRITESIL ® H20 Disilicate | 3 | 4 | PQ Corp. | Corrosion aid |
| TAED[1] | 2 | 2 | Aldrich | Bleach activator |
| TERGITOL ® L-61 | 0.5 | 0.5 | Dow | Surfactant |
| TRITON ® DF-16 | 1.5 | 1.5 | Dow | Surfactant |
| Protease from *Bacillus* | 0 | 1.25 | Aldrich | Cleaning agent |
| α-Amylase from *Bacillus* | 0 | 0.5 | Aldrich | Cleaning agent |
| Zinc carbonate | 0.1 | 0.1 | Aldrich | Corrosion aid |
| Sodium sulfate | Balance to 100% | Balance to 100% | Aldrich | Filler |

[1]TAED = N,N,N',N'-tetraacetylethylenediamine

Example 2—Performance of Dispersant Polymers in ADW Detergent Formulations—(United States Conditions)

To determine filming and spotting performance of automatic dishwashing detergent containing each of various polymers in accordance with the present invention, several ADW formulations were prepared (see Tables 3 and 4 below), each having different dispersant polymers and amounts thereof in either Base Formula A or B, and each sample ADW formulation was used to wash glasses in automatic dishwashing machines under the following conditions, which are typical of those found in the United States:

Machine: Kenmore Ultra Wash

Program: prewash, main wash at 65° C.

Water hardness: 375 ppm, ratio Ca/Mg 2/1

Detergent dosage is 20 grams per wash

The glasses are removed after the third, fifth and, in some cases, tenth cycles. Glasses are evaluated in a dark light box by visual observation and rated for filming and spotting.

Filming performance is assessed by trained panelists, and handled with cotton gloves. The evaluation is performed according to ASTM D3556 Standard test method for deposition on glass ware during mechanical dishwashing (Designation D3556-85, re-approved 2009) following the scoring system given below in a light chamber:

1 is best, no spotting, no filming;

2 is random spots and barely perceptible filming;

3 is about a fourth of the surface spotted, slight film;

4 is about half of the surface spotted, moderate film; and 5 is virtually completely covered with spots and heavy film.

Table 3 below summarizes the compositions of 6 comparative ADW formulations tested in connection with the present invention. Comparative ADW Formulations 1 to 6 were prepared using either Base Formula A or B, as indicated, and the listed amount of one or both of two prior art dispersants polymers, along with the listed amount of methylglycinediacetic acid (MGDA), but without any of the polymer having chelating moieties in accordance with the present invention.

Table 4 below summarizes the compositions of the 7 ADW formulations prepared and tested in accordance with the present invention, as well as Comparative 7. ADW Formulations 1 to 7 were prepared using either Base Formula A or B, as indicated, and the listed amount of ACUSOL® 588G as the polymer having sulfonic acid moieties (C), along with the listed amount of methylglycinediacetic acid (MGDA), as well as a polymer having chelating moieties (i.e., one of Polymers I-IV from Table 1 above) in accordance with the present invention.

Table 4 also contains a summary of the composition of Comparative example 7, an ADW formulation tested in connection with the present invention, which contains only a polymer having chelating moieties, but without any polymer having sulfonic acid moieties (C). Since Comparative 7 ADW formulation doesn't contain any of a polymer (C), it is comparative with respect to the present invention which requires the presence of both and a polymer (C) and a polymer (D) as described in detail hereinabove.

TABLE 3

| Compositions (wt %) of Comparative ADW Formulations | | | | | | |
|---|---|---|---|---|---|---|
| ADW Formulation ID<br>Base Formula A or B | Comparative 1<br>A | Comparative 2<br>A | Comparative 3<br>B | Comparative 4<br>B | Comparative 5<br>B | Comparative 6<br>B |
| Dispersant Package | | | | | | |
| MGDA | 15 | 15 | 15 | 15 | 15 | 15 |
| ACUSOL ® 588G (Polymer (C)) | 3.0 | 1.0 | | 3.0 | 2.0 | 3.0 |
| ACUSOL ® 445NG | | 2.0 | 3.0 | | 1.0 | |

MGDA = methylglycinediacetic acid; commercially available from BASF; function = builder/chelant
ACUSOL ® 588G is a acrylic acid-AMPS co-polymer commercially available from Dow Chemical Company
ACUSOL ® 445NG is a 100% acrylic acid homopolymer also commercially available from Dow Chemical Company

TABLE 4

| Compositions (wt %) of ADW Formulations of Present Invention | | | | | | | | |
|---|---|---|---|---|---|---|---|---|
| ADW Formulation ID<br>Base Formula A or B | ADW 1<br>A | ADW 2<br>A | ADW 3<br>A | ADW 4<br>A | ADW 5<br>B | ADW 6<br>B | ADW 7<br>B | Comparative 7<br>B |
| Dispersant Package | | | | | | | | |
| MGDA | 11 | 11 | 11 | 11 | 15 | 15 | 15 | 15 |
| ACUSOL ® 588 (Polymer (C)) | 1.0 | 1.0 | 1.0 | 1.0 | 2.0 | 2.0 | 2.0 | |
| ACUSOL ® 445 | — | — | — | — | — | — | — | — |
| Polymer I (RHR1008) | | | | 2.0 | | | | |
| Polymer II (RHR1040) | | | 2.0 | | | | | |
| Polymer III (RHR1041) | | 2.0 | | | | 1.0 | | |
| Polymer IV (RHR1057) | 2.0 | | | | 1.0 | | 1.0 | 3.0 |

Performance of Dispersant Polymers, Alone and in Combinations

The results of deposition scoring for the ADW formulations listed in each of Tables 5 and 6 above are presented below.

For runs reported below in Table 5, each run was done in presence of ballast which did not include food soil and, therefore, any scale present on the glasses is primarily inorganic scale, not organic scale or residual food soil.

For runs performed with ADW 7 and Comparative 6 ADW, reported below in Table 6, each run is done in presence of 50 grams frozen ballast added during main wash (IKW soil, Industrieverband Körperpflege and Waschmittel e.V., % content: Margarine (10.0); Milk (pasteurized, 3.5% fat) (5.0); Egg yolk (9.4); Benzoic acid (0.1); Potato Starch (0.5); Mustard (2.5); Ketchup (2.5); Water (70.0)).

TABLE 5

| Performance Results (Base Formula A) | | | | | | |
|---|---|---|---|---|---|---|
| | ADW Formulation ID | | | | | |
| | ADW 1<br>Ratings | ADW 2<br>Ratings | ADW 3<br>Ratings | ADW 4<br>Ratings | Comp. 1<br>Ratings | Comp. 2<br>Ratings |
| Control (Stripped glass) | 1.0 | 1.0 | 1.0 | 1.0 | 1.0 | 1.0 |
| After 3rd Cycle | 2.6 | 3.4 | 3.6 | 3.6 | 3.4 | 4.5 |
| After 5th Cycle | 3.2 | 3.5 | 3.8 | 3.4 | 3.5 | 4.7 |
| After 10th Cycle | 3.4 | 4.2 | 4.6 | 4.3 | 2.3 | 5.0 |

("Comp." means Comparative)

TABLE 6

| Performance Results (Base Formula B) | | | | | | | | |
|---|---|---|---|---|---|---|---|---|
| | ADW Formulation ID | | | | | | | |
| | ADW 5<br>Ratings | ADW 6<br>Ratings | ADW 7<br>Ratings | Comp. 3<br>Ratings | Comp. 4<br>Ratings | Comp. 5<br>Ratings | Comp. 6<br>Ratings | Comp. 7<br>Ratings |
| Control (Stripped glass) | 1.0 | 1.0 | 1.0 | 1.0 | 1.0 | 1.0 | 1.0 | 1.0 |
| After 3rd Cycle | 1.2 | 1.5 | 1.7 | 4.0 | 1.7 | 2.1 | 2.0 | 2.7 |

TABLE 6-continued

| Performance Results (Base Formula B) | | | | | | | | |
|---|---|---|---|---|---|---|---|---|
| | ADW Formulation ID | | | | | | | |
| | ADW 5 Ratings | ADW 6 Ratings | ADW 7 Ratings | Comp. 3 Ratings | Comp. 4 Ratings | Comp. 5 Ratings | Comp. 6 Ratings | Comp. 7 Ratings |
| After 5th Cycle | 1.7 | 1.9 | 2.2 | 4.5 | 2.2 | 2.2 | 2.2 | 3.2 |
| After 10th Cycle | n/a | n/a | n/a | n/a | n/a | n/a | n/a | n/a |

("Comp." means Comparative)

Example 3—Performance of Dispersant Polymers in ADW Detergent Formulas—European Conditions To determine filming performance of automatic dishwashing detergents containing each of various polymers in accordance with the present invention, several ADW formulations were prepared (see Tables 8 and 9 below), each having different dispersant polymers and amounts thereof in Base Formulas A and B, and each sample ADW formulation was used to wash glasses in automatic dishwashing machines under the following conditions:

Machines: Miele G1222SC Labor

Program: prewash, main wash at 65° C.

Water hardness: 37.5° fH, ratio Ca/Mg 3/1, HCO3 hardness=25° fH

Detergent dosage is 20 grams per wash

The glasses are removed after the third, sixth and tenth cycles. Glasses are evaluated in a dark light box by visual observation and rated for filming and spotting.

Filming performance is assessed by trained panelists, and glasses handled with cotton gloves. The evaluation is performed according to ASTM D3556 Standard test method for deposition on glass ware during mechanical dishwashing (Designation D3556-85, re-approved 2009) following the scoring system given below in a light chamber:

1 is best, no spotting, no filming;

2 is random spots and barely perceptible filming;

3 is about a fourth of the surface spotted, slight film;

4 is about half of the surface spotted, moderate film; and 5 is virtually completely covered with spots and heavy film).

Each run is done in presence of 50 grams frozen ballast added during main wash (IKW soil, Industrieverband Korperpflege and Waschmittel e.V., % content: Margarine (10.0); Milk (pasteurized, 3.5% fat) (5.0); Egg yolk (9.4); Benzoic acid (0.1); Potato Starch (0.5); Mustard (2.5); Ketchup (2.5); Water (70.0)).

Base Formula C was prepared and then used to formulate exemplary ADW detergent formulations containing varying types and combinations of dispersants (i.e., polymers having sulfonic acid moieties (C) and polymers having chelating moieties (D)) which were tested, as described in further detail below. The composition of Base Formula C is listed in Table 7.

TABLE 7

| Base Formulas C Compositions | | | |
|---|---|---|---|
| Ingredients | Formula C (wt %) | Supplier | Function |
| Sodium carbonate | 20 | Aldrich | Builder |
| Percarbonate | 10 | Aldrich | Bleaching agent |
| Sodium citrate | 10 | Aldrich | Builder |
| BRITESIL H20 (disilicate) | 10 | PQ Corp. | Corrosion aid |
| TAED[1] | 4 | Aldrich | Bleach activator |
| DOWFAX ®20B102 | 2 | Dow | Surfactant |
| Protease from *Bacillus* | 2.5 | Novozymes | Cleaning agent |
| α-Amylase from *Bacillus* | 1 | Novozymes | Cleaning agent |
| HEDP[2] | 0.5 | Thermphos | Corrosion aid |
| Sodium sulfate | Balance to 100% | Aldrich | Filler |

[1]TAED = N,N,N',N'-tetraacetylethylenediamine

[2]HEDP = 1-hydroxy ethylidene-1,1-diphosphonic acid

Table 8 below summarizes the compositions of 4 comparative ADW formulations and 2 exemplary ADW formulations tested in connection with the present invention. Comparative ADW Formulations 8 to 11 were prepared using Base Formula C and the listed amount of one or the other of two prior art dispersant polymers, or a polymer having chelating moieties in the absence of another dispersant, along with the listed amount of methylglycinediacetic acid (MGDA).

ADW Formulations 8 and 9 were prepared using Base Formula C and the listed amount of ACUSOL® 588 as the polymer having sulfonic acid moieties (C), as well as a polymer having chelating moieties (D) (i.e., one of Polymers V or VI from Table 1 above) in accordance with the present invention, along with the listed amount of methylglycinediacetic acid (MGDA).

TABLE 8

| Compositions (wt %) of Additional ADW Formulations Tested | | | | | | |
|---|---|---|---|---|---|---|
| | ADW Formulation ID | | | | | |
| | Comp. 8 | Comp. 9 | Comp. 10 | Comp. 11 | ADW 8 | ADW 9 |
| | All with Base Formula C | | | | | |
| Dispersant Package | | | | | | |
| MGDA | 30 | 20 | 20 | 20 | 20 | 20 |
| ACUSOL ® 588 (Polymer (C)) | | | 2.5 | | 1.25 | 0.8 |

TABLE 8-continued

| Compositions (wt %) of Additional ADW Formulations Tested | | | | | | |
|---|---|---|---|---|---|---|
| | ADW Formulation ID | | | | | |
| | Comp. 8 | Comp. 9 | Comp. 10 | Comp. 11 | ADW 8 | ADW 9 |
| | All with Base Formula C | | | | | |
| ACUSOL ® 445 | 2.5 | | | | | |
| Polymer V (RHR0982) | | | | 2.5 | 1.25 | 1.7 |
| Polymer VI (RHR1033) | | 2.5 | | | | |

("Comp." means Comparative)

The results of deposition scoring for the ADW formulations listed in Table 8 above are presented below in Table 9.

TABLE 9

| Performance Results (Base Formula A) | | | | | | |
|---|---|---|---|---|---|---|
| | ADW Formulation ID | | | | | |
| | Comp. 8 Ratings | Comp. 9 Ratings | Comp. 10 Ratings | Comp. 11 Ratings | ADW 8 Ratings | ADW 9 Ratings |
| After 3rd Cycle | 1.5 | 1.5 | 1.5 | 1.5 | 1.5 | 1.5 |
| After 6th Cycle | 2.0 | 1.5 | 2.5 | 2.5 | 2.0 | 2.0 |
| After 10th Cycle | 4.0 | 4.5 | 4.0 | 4.5 | 4.0 | 4.5 |

("Comp." means Comparative)

The invention claimed is:

1. An automatic dishwashing detergent, comprising:

(A) a builder;

(B) a surfactant;

(C) a polymer having sulfonic acid moieties and comprising polymerized units derived from at least one carboxylic acid monomer and at least one sulfonic acid monomer; and (D) a polymer having chelating moieties and comprising polymerized units derived from:

(i) at least one carboxylic acid monomer;

(ii) a glycidyl monomer selected from allyl glycidyl ether (AGE) or glycidyl (meth)acrylate (GA or GMA); and (iii) an aminocarboxylate selected from iminodiacetic acid (IDA), ethylenediamine triacetic acid (ED3A), their salts, or mixtures thereof, wherein the polymer (C) is different from the polymer (D).

2. The detergent according to claim 1, wherein said polymer (D) is selected from one of the following classes of polymers:

(1) a polymer comprising polymerized units derived from (i) at least one carboxylic acid monomer or its salt; (ii) at least one glycidyl monomer selected from allyl glycidyl ether (AGE) and glycidyl (meth)acrylate (GA or GMA); and (iii) iminodiacetic acid (IDA) or its salts, said polymer having Formula I:

Formula I

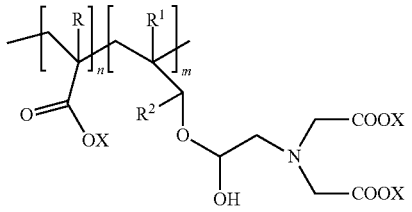

wherein m is an integer from 1 to 6; n is an integer from 1 to 20; each of R and $R^1$ is, independently, H or $CH_3$; $R^2$ is $H_2$ or =O; and each X is, independently, H, $K^+$, $Na^+$, or ammonium ($NH_4^+$); or (2) a polymer comprising polymerized units derived from (i) at least one carboxylic acid monomer or its salt; (ii) at least one glycidyl monomer selected from allyl glycidyl ether (AGE) and (meth)acrylate (GA or GMA); and (iii) ethylenediamine triacetic acid (ED3A) or its salts, said polymer having Formula II:

Formula II

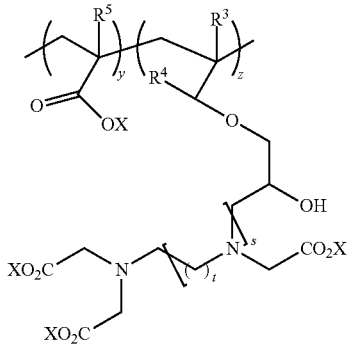

wherein s is 1, 2, or 3; t is 1, 2, or 3; z is an integer from 1 to 6; y is an integer from 1 to 20, each of $R^3$ and $R^5$ is, independently, H or $C_1$-$C_4$ alkyl; $R^4$ is $H_2$ or =O, X is, independently, H, $K^+$, $Na^+$, or ammonium ($NH_4^+$).

3. The detergent of claim 2, wherein said polymer (D) having Formula I comprises polymerized units derived from at least one carboxylic acid monomer and at least one ethylenically unsaturated aminocarboxylate monomer, wherein said ethylenically unsaturated aminocarboxylate monomer is the reaction product of said at least one glycidyl monomer and IDA.

4. The detergent of claim 2, wherein said polymer (D) having Formula II comprises polymerized units derived from at least one carboxylic acid monomer and at least one ethylenically unsaturated aminocarboxylate monomer, wherein said ethylenically unsaturated aminocarboxylate monomer is the reaction product of said at least one glycidyl monomer and ED3A.

5. The detergent of claim 1, wherein said at least one carboxylic acid monomer or its salt of said polymer (C) is selected from: acrylic acid, methacrylic acid, their salts, and mixtures thereof.

6. The detergent of claim 1, wherein said at least one sulfonic acid monomer or its salt of said polymer (C) is selected from 2-acrylamido-2-methylpropane sulfonic acid (AMPS), 2-(meth)acrylamido-2-methylpropane sulfonic acid, 4-styrenesulfonic acid, vinylsulfonic acid, 2-sulfoethyl (meth)acrylic acid, 2-sulfopropyl(meth)acrylic acid, 3-sulfopropyl(meth)acrylic acid, and 4-sulfobutyl(meth)acrylic acid, and salts thereof.

7. The detergent of claim 1, wherein said at least one carboxylic acid monomer is acrylic acid or its salt and said at least one sulfonic acid monomer is 2-acrylamido-2-methylpropane sulfonic acid (AMPS).

8. The detergent of claim 1, wherein said at least one carboxylic acid monomer or its salt of said polymer (D) is selected from: acrylic acid, methacrylic acid, their salts, and mixtures thereof.

9. The detergent of claim 2, wherein said polymer (D) has Formula I and comprises polymerized units derived from (i) at least one carboxylic acid monomer or its salt, (ii) allyl glycidyl ether (AGE); and (iii) iminodiacetic acid (IDA) or its salts.

10. The detergent of claim 2, wherein said polymer (D) has Formula II and comprises polymerized units derived from (i) at least one carboxylic acid monomer or its salt, (ii) allyl glycidyl ether (AGE); and (iii) ethylenediamine triacetic acid (ED3A) or its salts.

11. The detergent of claim 2, wherein said polymer (D) has Formula II and comprises polymerized units derived from (i) at least one carboxylic acid monomer or its salt, (ii) glycidyl methacrylate (GMA), and (iii) ethylenediamine triacetic acid (ED3A) or its salts.

* * * * *